US007537466B2

(12) United States Patent
Bartholoma et al.

(10) Patent No.: US 7,537,466 B2
(45) Date of Patent: May 26, 2009

(54) PLUG WITH RETAINER SPRING FOR AN EARTH CONTACT

(75) Inventors: Mario Bartholoma, Winden (DE); Fritz Zugel, Waldkirch (DE); Achim Hoch, Waldkirch (DE)

(73) Assignee: Anton Hummel Verwaltungs GmbH, Waldkirch (DE)

( * ) Notice: Subject to any disclaimer, the term of this patent is extended or adjusted under 35 U.S.C. 154(b) by 0 days.

(21) Appl. No.: 11/994,468

(22) PCT Filed: Jul. 12, 2006

(86) PCT No.: PCT/EP2006/006810

§ 371 (c)(1),
(2), (4) Date: Jan. 2, 2008

(87) PCT Pub. No.: WO2007/019918

PCT Pub. Date: Feb. 22, 2007

(65) Prior Publication Data

US 2008/0214028 A1 Sep. 4, 2008

(30) Foreign Application Priority Data

Aug. 12, 2005 (DE) ..... 20 2005 012 756 U

(51) Int. Cl.
*H01R 4/66* (2006.01)

(52) U.S. Cl. ..... 439/95

(58) Field of Classification Search ..... 439/95, 439/607, 744, 92

See application file for complete search history.

(56) References Cited

U.S. PATENT DOCUMENTS

| | | | | | |
|---|---|---|---|---|---|
| 2,872,657 | A | * | 2/1959 | Peterson | 439/607 |
| 3,920,304 | A | * | 11/1975 | Bromberg | 439/274 |
| 3,930,709 | A | * | 1/1976 | Stanger et al. | 439/185 |
| 3,997,235 | A | * | 12/1976 | Boliver | 439/185 |
| 4,202,591 | A | * | 5/1980 | Borgstrom | 439/185 |
| 5,181,860 | A | * | 1/1993 | Honma et al. | 439/321 |
| 5,240,424 | A | * | 8/1993 | Honma et al. | 439/95 |
| 5,346,403 | A | * | 9/1994 | Hyzin | 439/95 |
| 5,586,911 | A | * | 12/1996 | Miller et al. | 439/607 |
| 2001/0002343 | A1 | * | 5/2001 | Suzuki | 439/101 |

FOREIGN PATENT DOCUMENTS

| | | |
|---|---|---|
| DE | 3912189 | 10/1990 |
| DE | 4102681 | 8/1992 |
| DE | 20018034 | 3/2001 |
| EP | 0449737 | 10/1991 |
| EP | 0475414 | 3/1992 |
| EP | 1275173 | 1/2003 |

* cited by examiner

*Primary Examiner*—T C Patel
*Assistant Examiner*—Vladimir Imas
(74) *Attorney, Agent, or Firm*—Volpe and Koenig P.C.

(57) ABSTRACT

A plug (1) with a housing in the form of a sleeve (2) and an insulating body (3) arranged therein is provided, which retains extended contacts (4), which includes an electrically conductive retainer spring (9) for a ground contact (5) having a sleeve-like plug-in piece (10) for the ground contact (5) arranged in a hole or perforation (6) of the insulating body (3), which has a free passage in an axial direction, the plug-in piece (10) accommodating the retainer spring (9) via a lateral opening (8) in the insulating body (3), and the hole or perforation (6) forms with the lateral opening (8) a back-cut for the somewhat elastically compressible plug-in piece (10). A spring arm (11) extends along an outer side of the plug-in piece (10) arranged on the outside of the insulating body (3), even when in use, which contacts the inner side of the sleeve (2) and has an inwardly directed projection (12) arranged on a free end thereof which engages in a depression or recess (7) on the ground contact (5) and fixes the ground contact (5) in the axial direction.

14 Claims, 4 Drawing Sheets

PLUG WITH RETAINER SPRING FOR AN EARTH CONTACT

BACKGROUND

The invention relates to a plug with a bushing and with an insulating body arranged in the bushing in the position of use, as well as with elongated contacts, which are held in perforations or boreholes of the insulating body, wherein a contact is arranged as a ground contact parallel to the other contacts within a perforation or borehole, which has a lateral opening for an electrically conductive retainer spring that fixes the ground contact in the position of use in its perforation or borehole.

Such a plug is known from EP 1 275 173 B1 and has proven itself, because it is simple in production and, for a one-part construction of the insulating body, it allows the fixing of the contacts, whether contact pins or contact sockets, in a simple way.

Here, EP 1 275 173 B1 also produces the possibility of grounding one of the contact pins with a retainer spring, thus, using it as a ground contact and in this way simultaneously also fixing it in the axial direction of its profile within the insulating body. The retainer spring provided here has two spring arms engaging and surrounding the ground contact in a locking manner and must be inserted radially through a lateral opening of the insulating body after the insertion of the ground contact. This makes the assembly more difficult, because the contact pin is fixed in the correct positional arrangement only when the retainer spring, on its side, is mounted. In addition, the contact surface on the spring arms is relatively small.

SUMMARY

Therefore there arises the objective of creating a plug of the type defined above, in which the assembly of the ground contact is simplified and the contact surface can be increased.

To meet this objective, it is provided that the retainer spring has a plug-in part, which allows passage in the axial direction and which is arranged within the perforation or borehole of the insulating body in the position of use and whose open inner cross section corresponds approximately to the outer cross section of the essentially pin-shaped ground contact and which is located in the position of use within the insulating body in alignment with or coaxial to the opening or perforation of the insulating body for the ground contact, so that this ground contact can be inserted into the plug-in part during the insertion in its perforation or borehole, such that the plug-in part of the contact spring fits through the lateral opening of the insulating body and carries at least one spring arm extending on its outside, which has, on a free end extending past the plug-in part, a projection that is directed radially inwardly and that reaches into the plug-in path of the ground contact and that applies a fixing force onto the ground contact in the position of use.

In this way, it is possible to insert the retainer spring with its plug-in part from the side into the insulating body and then to shift and position the ground contact in the axial direction into its position of use like the other contacts, whether it is a pin or socket. In this way, the ground contact automatically penetrates the plug-in part and comes in contact with this part. The plug-in part and the retainer spring can already be provided on the insulating body, before the ground contact is mounted. Then the assembly of this ground contact is simple accordingly through simple pushing into its perforation or borehole and, in this way, also into the plug-in part of the retainer spring. Simultaneously, the spring arm can fix, that is, set, the ground contact with its projection, so that a simple plug-in motion, which is also already a typical motion, is sufficient for mounting the ground contact.

Here, for simple assembly and fixing of the ground contact, it is especially useful when the ground contact has a recess at the position acted upon by the projection of the spring arm and the pivoting path of the spring arm corresponds at least to the engagement depth of its projection into this recess or depression. When pushing the ground contact into its perforation or borehole, the projection of the spring arm is first pressed by the penetrating ground contact to the side and therefore the spring arm moves until it springs into the recess and therefore can fix the ground contact. Thus, when pushing in the ground contact, a locking or snap-in attachment can be realized automatically by the electrically conductive retainer spring.

For a non-tensioned spring, the spring arm can extend with its projection through a lateral opening of the insulating body into the interior of the opening or borehole and can pivot in the radial direction through the ground contact that can be plugged in. As mentioned, for its axial plug-in motion, in this way the ground contact can force the projection of the spring arm initially located partially in its shifting path to the side or in the radial direction and can therefore pivot the spring arm until the recess used for locking the projection of the spring arm comes into the region of this projection.

Here, the lateral opening for the projection of the spring arm can be arranged in the axial direction adjacent to the lateral opening for the insertion of the plug-in part in the insulating body. Thus, the insulating body is provided with lateral openings only as little as is necessary or these have the smallest possible dimensions, which are sufficient, on one hand, for allowing the plug-in part to pass, and wherein, on the other hand, an adjacent opening with correspondingly smaller dimensions allows the passage of the projection of the spring arm in the radial direction from the outside to the inside in the path of the ground contact. In addition, the part of the insulating body located between the lateral openings supports the spring arm from the inside, so that it can tightly contact and ground the inside of the bushing.

It is especially favorable when the recess on the ground contact for the engagement with the projection of the spring arm has a surrounding, ring-like shape and/or is bounded in the plug-in direction by a surrounding ring or collar, which is constructed, on its side facing away from the recess, in particular, in a tapering, conical, or truncated cone-like manner.

The ring shape of the recess allows the ground contact, which usually has a circular cross section, to be introduced into its perforation or borehole in any rotational orientation and to nevertheless allow a locking or snap-in connection with the tongue-like projection of the spring arm. The tapering shape of the boundary of the recess in the plug-in direction before this recess simplifies the lateral displacement of the spring arm with its projection.

For the most precise positioning possible for the ground contact, it can be advantageous when the projection of the spring arm has on its free end a holding tongue or wider section oriented especially in the axial direction, with which the recess is filled, or a stop for one of the boundaries of the recess can be realized for when the ground contact has reached its exact axial position.

It is especially favorable when the plug-in part of the retainer spring has greater lateral dimensions than the lateral opening of the insulating body and corresponds approximately to the lateral dimensions or the diameter of the perforation or borehole for the ground contact, and when the plug-in part can be compressed perpendicular to its inner longitudinal hollow space or in the radial direction against its elasticity so far that it can be inserted through the lateral opening, which can also have an approximately conical shape. The plug-in part thus can be brought through a lateral opening of the insulating body into its position of use and then can engage behind the edges of the lateral opening due to its inherent elasticity, so that it is held in a captive and essentially positive-fit manner. Advantageously, the retainer spring can be pre-assembled, so that then only the ground contact must be pushed in and locked to complete the assembly.

Here, it is favorable that the plug-in part is secured or locked against radial compression by the ground contact passing through it especially in a positive-fit manner. Thus, if the ground contact is located in the position of use, the retainer spring can no longer be pulled out of the lateral opening of the insulating body. Simultaneously, however, the spring arm extends on this outside of the lateral opening and can come into contact with the bushing holding the insulating body, in order to create the desired grounding.

It is useful when the plug-in part of the retainer spring is constructed as a bushing, which contacts the ground contact in the position of use on the outside at least in some areas over a surface. A correspondingly large contact surface between the retainer spring and the ground contact is made available in this way. Here, the electrically conductive retainer spring can be made, at least in some areas, from a material, in particular, metal, which conducts electrical current.

Furthermore, it is favorable when the bushing-shaped plug-in part has an especially continuous slot or similar gap extending approximately in the axial direction and has, in the non-tensioned state, a smaller cross section than the ground contact. When inserted into its position of use, it then expands the plug-in part, so that this forms a good contact on the ground contact due to the resulting restoring forces and leads to a correspondingly secure electrical contact.

The spring arm can be formed, in particular, in one piece on the front end of the retainer spring in the plug-in direction and can be arranged extending in the plug-in direction. Therefore, this spring arm extends over the greatest possible length of the retainer spring and can produce a good contact on the bushing of the plug. In addition, for the axial insertion of the ground contact and its force applied to the projection of the spring arm, in addition to the radial pivoting, also a certain axial loading is produced, which acts on the spring arm as a tensile force for the mentioned arrangement and therefore cannot lead to its compression.

The retainer spring has an especially economical construction when it is bent with its plug-in part and with its spring arm especially in one piece from one part or stamped part. A somewhat wider part of such a stamped part can be rolled to form a bushing, while a narrower part coming from this wider part can form the spring arm, on whose free end the mentioned projection can also be formed with an additional retaining tongue or similar wider section.

It should also be mentioned that the spring arm of the retainer spring can have a wider section running in the transverse direction of its extension, in order to increase the contact surface to the inside of the current-conducting bushing of the plug.

Above all, for the combination of individual or several of the features and measures described above, a plug is realized with an insulating body, ground contact, and retainer spring, which takes hold of and fixes this ground contact and which can be assembled through a simple plug-in motion, wherein, nevertheless, the ground contact can be fixed, contacted, and positioned with good results, because the retainer spring creates not only the electrical contact, but also the fixing and attachment of the ground contact with the help of a spring arm, wherein this spring arm has a double function, because in addition to this fixing of the ground contact, it also produces the contact to the bushing of the plug. Thus, this spring arm is simultaneously a grounding spring.

A relatively simple production of the parts on one hand and an effective contact on the other hand is produced when the spring arm acting as a grounding spring has a flat, smooth cross section bounded by straight lines and is clamped in the joint with a circular-arc cross section between the inside of the bushing with a circular cross section and the outside of the insulating body. Because the cross section of the spring arm does not fit exactly to that of the joint, it is pressed with corresponding strength at corresponding contact positions and possibly also somewhat deformed, which leads to a correspondingly good electrical contact.

BRIEF DESCRIPTION OF THE DRAWINGS

Below, an embodiment of the invention is described in more detail with reference to the drawing. Shown in partially schematic representation are.

DETAILED DESCRIPTION OF THE PREFERRED EMBODIMENTS

Figure 1:
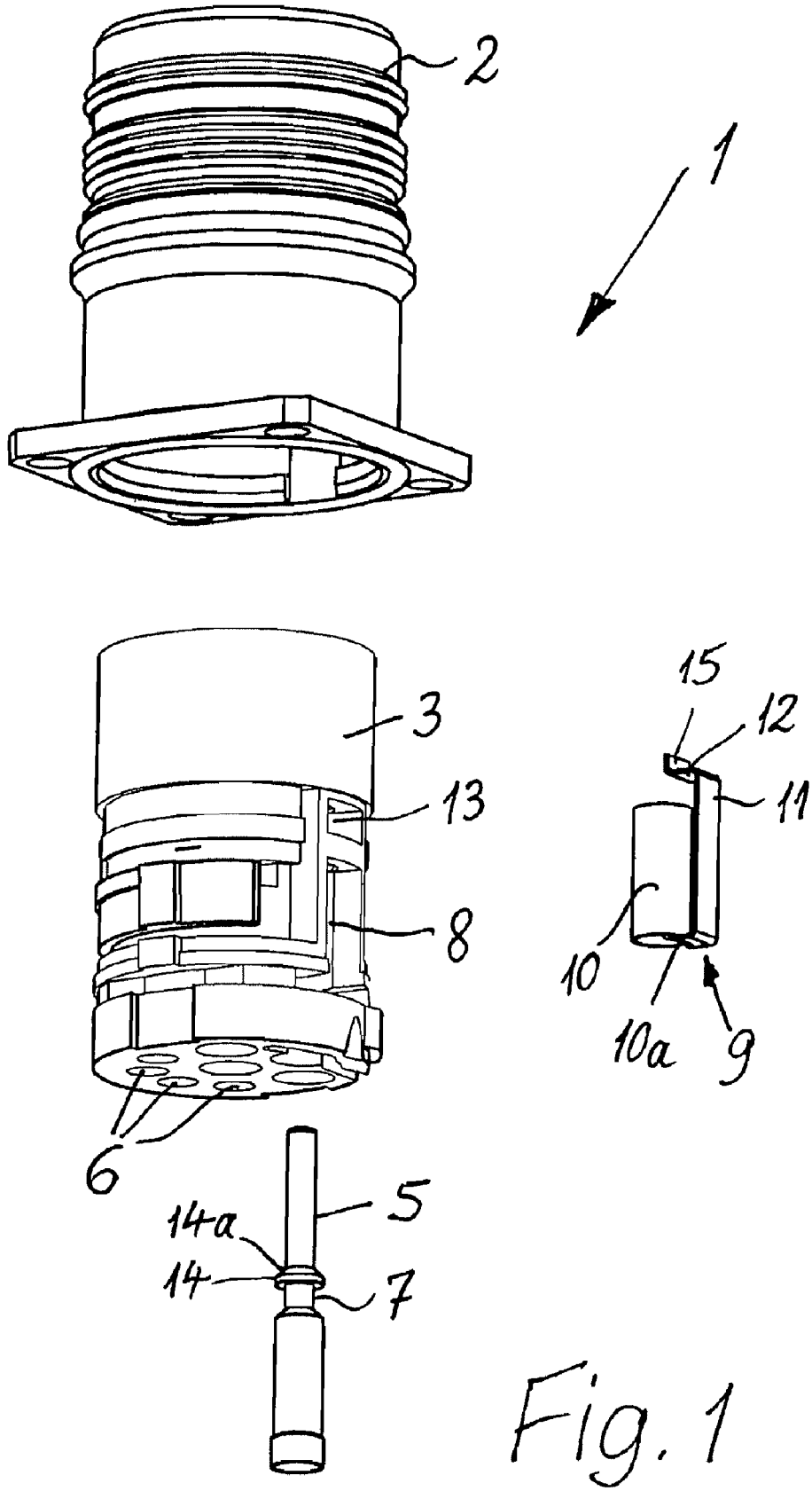
FIG. 1 a view of the individual parts of the plug according to the invention shortly before its assembly, thus, the insulating body and the retainer spring before this spring is inserted from the side into the insulating body, after which the ground contact is then inserted in the axial direction and the entire insulating body can be pushed into the bushing, FIG. 2 a side view of the assembled plug according to FIG. 1, FIG. 3 a cross section of the plug along the line A-A in FIG. 2, FIG. 4 a partial view according to the region B as indicated in FIG. 3 of the ground contact and the retainer spring gripping it, shown in an enlarged scale relative to FIG. 3, FIG. 5 a longitudinal section view of the insulating body and the assembled ground contact, as well as additional contacts, wherein the sectional plane extends through the longitudinal center of the ground contact and the spring arm of the retainer spring, similarly visible partially in section, can be seen in the position of use, FIG. 6 a perspective side view of a retainer spring with plug-in part, spring arm, and projection, wherein the retainer spring is fixed on the front end of the plug-in part in the plug-in direction in one piece by means of bending and extends in the plug-in direction of a ground contact approximately parallel to the longitudinal center axis of the plug-in part, FIG. 7 a flat pattern (unwound) view of the retainer spring according to FIG. 6 or a part, which has been stamped out, for example, and from which the retainer spring according to FIG. 6 can be bent and produced, FIG. 8 an embodiment modified relative to FIG. 6, in which the spring arm has a wider section, with which the contact surface is enlarged relative to the bushing forming the housing of the plug, and also FIG. 9 a flat pattern (unwound) view or the stamped part, from which the retainer spring according to FIG. 8 is bent and produced.
Figure 2:
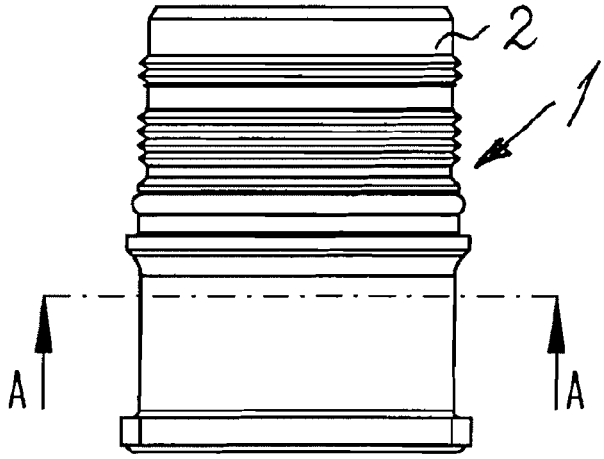

The plug 1 shown in its completed state in FIG. 2 and in individual parts in FIG. 1 has a bushing 2 forming its housing and an insulating body 3 arranged and fixed in the position of use in the interior of this bushing 2, as well as elongated pin-like contacts 4, which can be contact pins or contact sockets, for which the counter plug then features pins.

Typically before or after assembly, cables or wires are attached, for example, soldered, to these contacts 4.

The insulating body 3 contains perforations or boreholes 6, in which the contacts 4 are fixed, wherein a contact is arranged as ground contact 5 parallel to the other contacts 4 within one of these perforations or boreholes 6, which has a lateral opening 8 for an electrically conductive retainer spring that is designated as a whole with 9 and that fixes the ground contact 5 in the position of use in its perforation or borehole 6.

Figure 3:
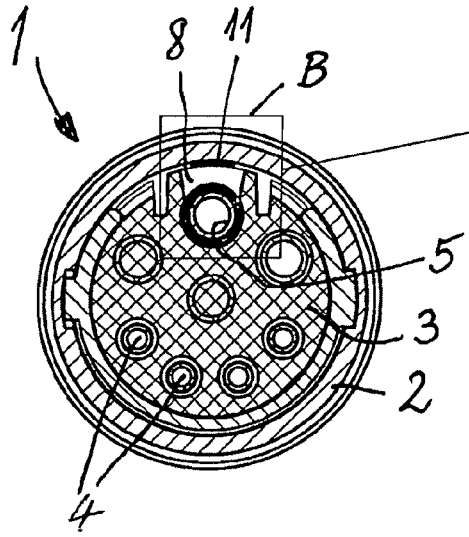
Figure 4:
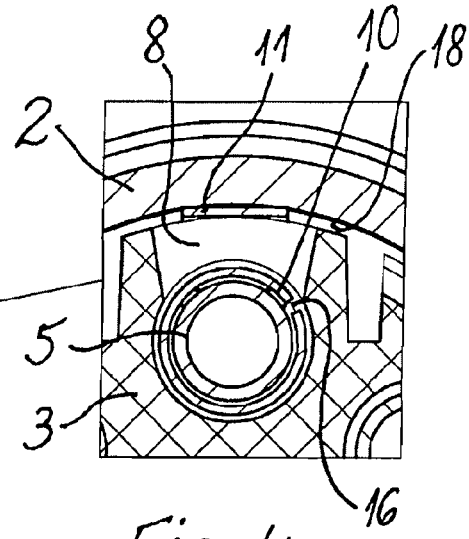
Figure 5:
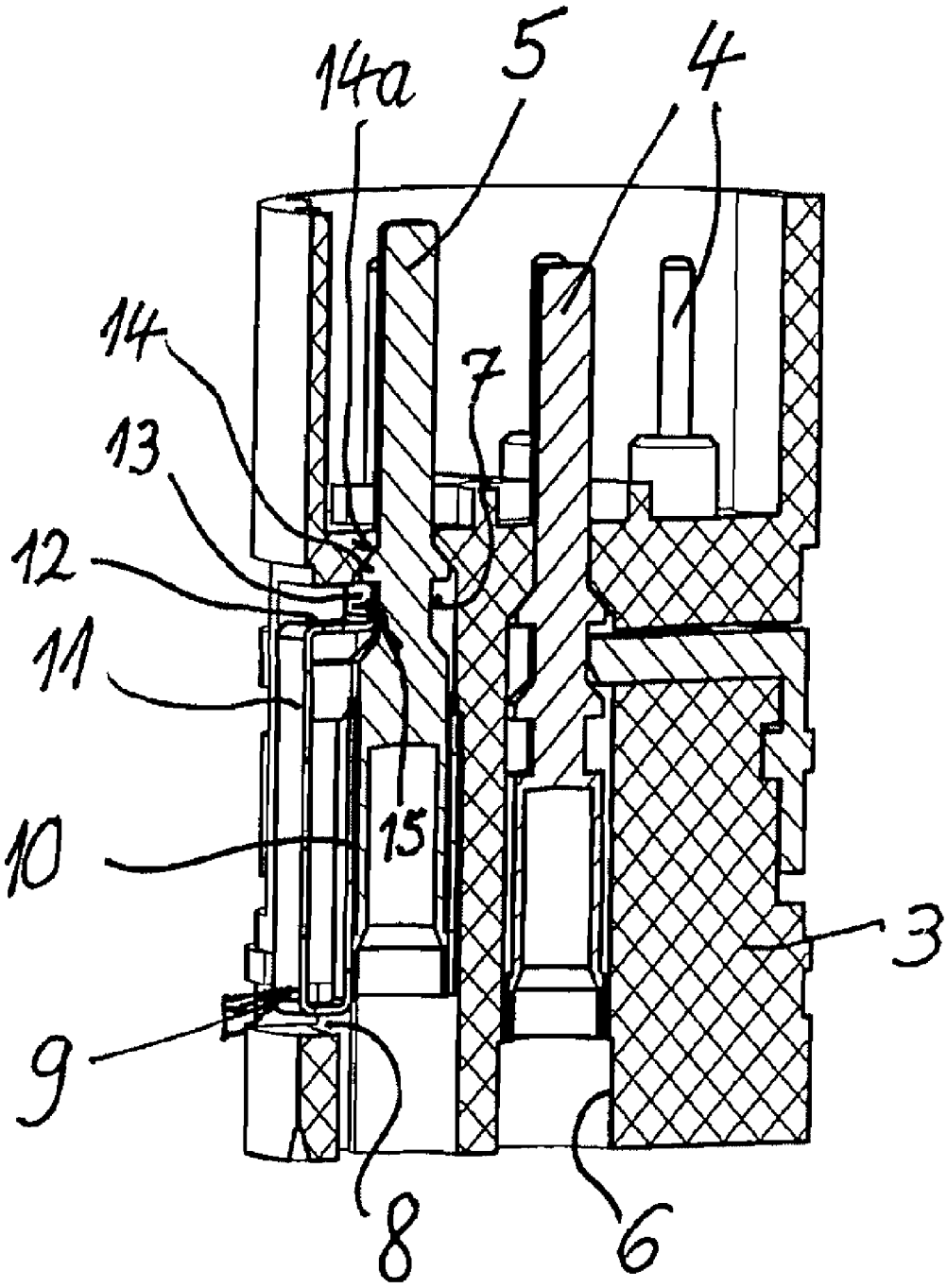
Figure 6:
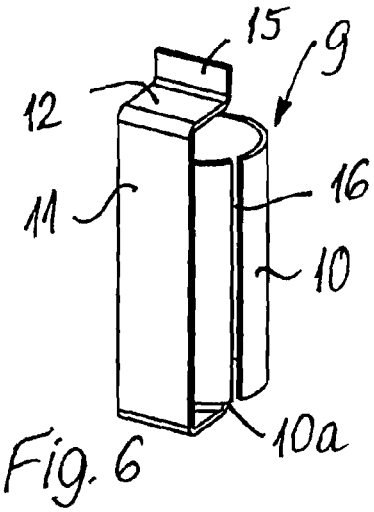
Figure 8:
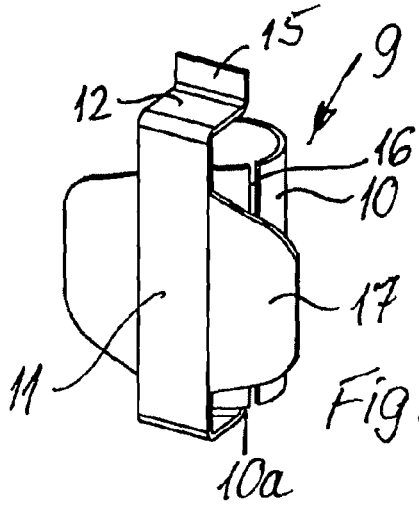

Primarily in FIGS. 1, 6, and 8, but also in FIGS. 4 and 5, one can see that the retainer spring 9 has a plug-in part 10, which allows passage in the axial direction and which is arranged in the position of use within the perforation or borehole 6 of the insulating body 3 and whose open inner cross section according to FIGS. 3 to 5 corresponds approximately to the outer cross section of the essentially pin-shaped or bushing-shaped ground contact 5 and which is located in the position of use within the insulating body 3 in alignment with and coaxial to the opening or perforation 6 of the insulating body 3 for the ground contact 5. The ground contact 5 can be simultaneously pushed and plugged into this previously assembled plug-in part 10 during the axial insertion into its perforation or borehole 6.

Here, the plug-in part 10 of the retainer spring 9 fits through the lateral opening 8 of the insulating body 3, thus, it can be brought from the side through this opening 8 into its position of use. In FIG. 1, the retainer spring 9 and its plug-in part 10 can still be seen before this assembly, while FIGS. 3 and 4 show the position of use of the retainer spring 9 and its plug-in part 10. Here, one can also see in FIGS. 3 and 4 that the lateral opening 8 has a slight conical construction with a cross section becoming somewhat smaller toward the middle of the insulating body 3, which simplifies the insertion of the plug-in part 10.

Primarily in FIGS. 1, 6, and 8, and also in FIGS. 4 and 5, one can also see that the plug-in part 10 carries a spring arm 11, which extends on its outside and which has, on its free end projecting past the plug-in part 10, a projection 12, which is directed radially inwardly and which extends into the plug-in path of the ground contact 5 and which applies force on the ground contact 5 in the position of use in a way still to be described in a fixing and setting manner in the axial direction.

Primarily in FIG. 1 it is shown that the ground contact 5 has, at the position acted upon by the projection 12 of the spring arm 11 in the position of use, a recess 7 and the pivoting path of the spring arm 11 corresponds at least to the engagement depth of its projection 12 in this depression or recess 7.

According to FIG. 5, the projection 12 of the spring arm 11 extends for a non-tensioned position or non-tensioned spring through a lateral opening 13 of the insulating body 3 into the interior of the opening or borehole 6 and can pivot radially via contact with the ground contact 5 that can be plugged in. Here, the lateral opening 13 for the projection 12 of the spring arm 11 is arranged in the axial direction adjacent to the lateral opening 8 for the insertion of the plug-in part 10 in the insulating body 3, wherein the two openings 8 and 13 are of corresponding dimensions to the dimensions and distances of the plug-in part 10 and the projection 12 from each other.

In FIG. 1, one can see that the recess 7 has a surrounding, ring-shaped construction on the ground contact 5, which is provided for the engagement of the projection 12 of the spring arm 11, that is, it is constructed as a ring groove and thus allows any rotational position of the ground contact 5 for its assembly.

Here, one can further see that the ring groove-like recess 7 is bounded by a surrounding ring or collar 14, which is constructed in a narrowing, conical, or truncated cone-like way on its front side 14*a* in the plug-in direction facing away from the recess 7, in order to simplify the force application and radial pivoting of the projection 12 of the spring arm 11 when pushing in the ground contact 5.

For good axial positioning, it is provided that the projection 12 of the spring arm 11 has, on its free end, a holding tongue 15, which is oriented in the axial direction and which, according to FIG. 5, abuts against the boundary of the groove 7 formed as a collar 14 in the position of use.

Primarily with reference to FIGS. 3 and 4, it becomes clear that the plug-in part 10 of the retainer spring 9 has greater lateral or radial dimensions than the lateral opening 8 of the insulating body 3 and in this way corresponds approximately to the lateral dimensions or the diameter of the perforation or borehole 6 for the ground contact 5, so that the plug-in part 10 in the position of use practically fills up this borehole 6 with its outer side. Simultaneously, the plug-in part 10 can be compressed perpendicular to its inner longitudinal hollow section or in the radial direction against the elasticity of its material sufficiently so that it can be inserted through the lateral opening 8. Here, this lateral or radial compression can be supported by the approximately conical shape of the lateral opening 8. The user can thus insert the retainer spring 9 and here primarily its plug-in part 10 into the lateral opening 8 and press the retainer spring 9 parallel to itself through the opening 8, wherein the plug-in part 10 first yields somewhat, in order to then assume its original shape again in the interior of the perforation or borehole 6. In this way, the plug-in part 10 reaches a kind of undercut and is held with a positive fit and thus in a captive manner. Thus, the plug-in part 10 is secured or blocked in the position of use by the ground contact 5 passing through it with a positive fit against radial compression and therefore the two parts, namely the ground contact 5 and the retainer spring 9 are mutually held rigidly in their position of use.

The plug-in part 10 of the retainer spring 9 is here constructed as a bushing, which contacts the ground contact 5 in the position of use on the outside at least in some regions over an area, which produces a good electrical contact that, however, is also still supported by the projection 12 of the spring arm 11 and its holding tongue 15, so that in each case a good electrical contact is produced between the ground contact 5 and the retainer spring 9, even if intermediate spaces should appear in one or the other region.

The distance between the plug-in part 10 and ground contact 5 visible in FIG. 4 is provided, according to FIG. 5, only over a part of the length of this ground contact 5.

According to FIGS. 4, 6, and 8, the bushing-shaped plug-in part 10 has a slot 16 or similar gap extending approximately in the axial direction and can have in the non-tensioned state a smaller cross section than the ground contact 5, so that this can expand somewhat when the bushing-shaped plug-in part 10 is inserted, in order to improve the contact.

The electrically conductive retainer spring 9 is made, at least in some regions, namely from material, in particular, metal, which conducts electrical current. Here, primarily in FIGS. 1, 5, and 6 to 9, is becomes clear that the spring arm 11 is formed in one piece on the front end 10*a* of the plug-in part 10 and the retainer spring 9 in the plug-in direction of the ground contact 5 and is arranged extending in the plug-in direction. When inserting the ground contact 5, this initially comes in contact with the end 10*a* of the retainer spring 9, from which the spring arm 11 extends in the direction of the additional plug-in motion. In this way, it is achieved that when the projection 12 of the spring arm 11 receives force from the projection or collar 14 of the ground contact 5, the spring arm 11 is deflected not only laterally in the radial direction to the outside, but also is subjected to a certain tensile force, so that there is no risk that this spring arm 11 will be compressed.

The retainer spring 9 is here bent in one piece with its plug-in part 10 and with its spring arm 11 from one part, preferably from one stamped part. Corresponding stamped parts are shown in FIGS. 7 and 9 and one can clearly see a wider region, which forms the plug-in part 10 and from which the spring arm 11 projects.

Figure 9:
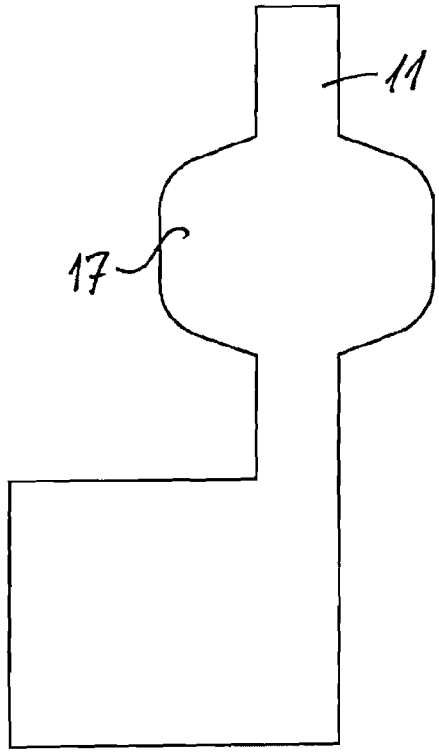

Here, FIGS. 8 and 9 show that the spring arm 11 of the retainer spring 9 can have a wider section 17, which runs in the transverse direction of its extent and which can increase the contact to the inside of the electrically conductive bushing 2.

Figure 7:
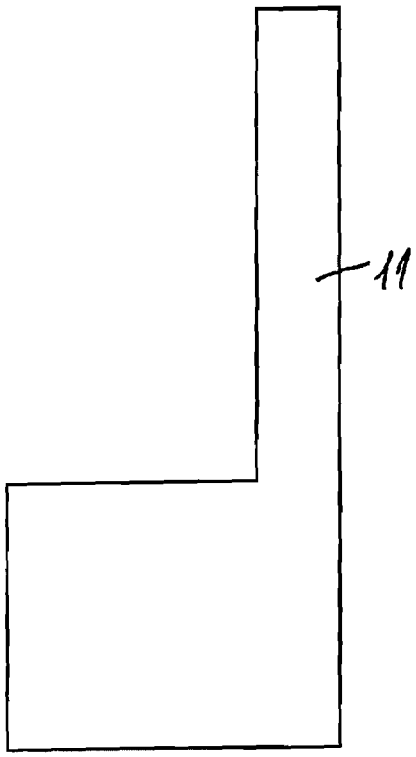

According to FIGS. 4, 7, and 9, the spring arm 11 used as a grounding spring has a flat, smooth cross section and is clamped in the position of use in the joint 18 with a circular arc-like cross section between the inside of the bushing 2 with a circular cross section and the outside of the insulating body 3, which produces a correspondingly good contact.

The plug 1 with a housing constructed as a bushing 2 and an insulating body 3, which is arranged therein and which holds elongated contacts 4, has an electrically conductive retainer spring 9 for a ground contact 5 that has a preferably bushing-shaped plug-in part 10, which allows passage in the axial direction and which is arranged in the position of use within a perforation or borehole 6 of the insulating body 3 for the ground contact 5, wherein the plug-in part 10 of the retainer spring 5 fits through a lateral opening 8 of the insulating body 3 and the borehole 6 forms with this lateral opening 8 an undercut for the plug-in part 10 that can be compressed somewhat elastically. On the outside of the plug-in part 10 extends a spring arm 11, which is also arranged in the position of use on the outside of the insulating body 3 and which contacts the inside of the bushing 3 and which has a projection 12 that is arranged on its free end and that is directed inward and that engages in a recess or depression 7 of the ground contact 5 and that fixes the ground contact 5 in the axial direction.

The invention claimed is:

1. Plug (1) comprising a bushing (2) and an insulating body (3) arranged in the position of use in the bushing (2), and also with elongated contacts (4), which are held in perforations or boreholes (6) of the insulating body that extend in an axial direction, wherein one of the contacts is arranged as a ground contact (5) parallel to other ones of the contacts (4) within one of the perforations or boreholes (6), which has a lateral opening (8) for an electrically conductive retainer spring (9) that fixes the ground contact (5) in the position of use in the perforation or borehole (6), the retainer spring (9) has a plug-in part (10), which allows passage in an axial direction and which is arranged in the position of use within the one of the perforations or boreholes (6) of the insulating body (3) and has an open inner cross section that corresponds approximately to an outer cross section of the ground contact (6) which is generally pin-shaped and which is located in the position of use within the insulating body (3) in alignment with or coaxial to the one of the openings or perforations (6) of the insulating body (3) for the ground contact (5), so that the ground contact can be plugged in during the insertion into the perforation or borehole (6) for the ground contact in the plug-in part (10), and the plug-in part (10) of the retainer spring (9) fits and is insertable through the lateral opening (8) in a direction perpendicular to the perforations or boreholes (6) of the insulating body (3) and carries at least one spring arm (11), which extends in the axial direction on an outside thereof and which has, on a free end of the spring arm (11) projecting past the plug-in part (10), a projection (12) that is directed inwardly in a radial direction and that extends into a plug-in path of the ground contact (5) and acts on the ground contact (5) in the position of use in a fixing manner, and the ground contact (5) has, at the position acted upon by the projection (12) of the spring arm (11), a recess or depression (7) and a pivot path of the spring arm (11) corresponds at least to an engagement depth of the projection (12) into the recess or depression (7).

2. Plug according to claim 1, wherein the spring arm (11) projects, for a non-tensioned spring, with the projection (12) through a second lateral opening (13) of the insulating body (3) into an interior of the opening or borehole (6) and can pivot in a radial direction via contact with the ground contact (5) that can be plugged in.

3. Plug according to claim 2, wherein the second lateral opening (13) for the projection (12) of the spring arm (11) is arranged in the axial direction adjacent to the lateral opening (8) for the insertion of the plug-in part (10) into the insulating body (3).

4. Plug according to claim 1, wherein the recess (7) has a surrounding, ring-like shape on the ground contact (5) for engagement of the projection (12) of the spring arm (11) on the ground contact or is bounded, in a plug-in direction, by a surrounding ring or collar (14), which is constructed on a side (14*a*) thereof facing away from the recess (7) in a narrowing, conical, or truncated cone-like manner.

5. Plug according to claim 1, wherein the projection (12) of the spring arm (11) has, on a free end thereof, a holding tongue (15) or wider section oriented in the axial direction.

6. Plug according to claim 1, wherein the plug-in part (10) of the retainer spring (9) has a greater lateral dimension than the lateral opening (8) of the insulating body (3) and corresponds approximately to a lateral dimension or diameter of the perforation or borehole (6) for the ground contact (5), and the plug-in part (10) can be compressed perpendicular to an inner longitudinal hollow space thereof or in a radial direction against an elasticity thereof so far that it can be inserted through the lateral opening (8).

7. Plug according to claim 6, wherein the plug-in part (10) is secured or blocked in the position of use by the ground contact (5) passing through it with a positive fit against radial compression.

8. Plug according to claim 1, wherein the plug-in part (10) of the retainer spring (9) is constructed as a bushing, which contacts the ground contact (5) in the position of use on an outside thereof at least in some regions over an area thereof.

9. Plug according to claim 8, wherein the bushing-shaped plug-in part (10) has at least one slot (16) or similar gap extending approximately in the axial direction and has a smaller cross section than the ground contact (5) in a non-tensioned state.

10. Plug according to claim 1, wherein the electrically conductive retainer spring (9) is made, at least in some regions, from a material which conducts electrical current.

11. Plug according to claim 1, wherein the spring arm (11) is formed in one piece on a front end (10*a*) of the retainer spring (9) in the plug-in direction of the ground contact (5) and the plug-in part (10) and is arranged extending in the plug-in direction.

12. Plug according to claim 1, wherein the retainer spring (9) is bent with the plug-in part (10) and with the spring arm (11) especially in one piece from one part or stamped part.

13. Plug according to claim 1, wherein the spring arm (11) of the retainer spring (9) has a wider section (17) extending in a transverse direction of an extension direction thereof.

14. Plug according to claim 1, wherein the spring arm (11) used as a grounding spring has a flat, smooth cross section and is clamped in the position of use in a joint (18) with a circular arc-shaped cross section between an inside of the bushing (2) with a circular cross section and an outside of the insulating body (3).

* * * * *